US006131626A

United States Patent [19]

Raill

[11] Patent Number: 6,131,626

[45] Date of Patent: Oct. 17, 2000

[54] POWER TOOL MOUNTING JIG

[76] Inventor: Donald Raill, 2494 Route 125 South, St. Donat, Quebec, Canada, J0T 2C0

[21] Appl. No.: 09/478,223

[22] Filed: Jan. 5, 2000

[30] Foreign Application Priority Data

Jan. 8, 1999 [CA] Canada ..... 2258245

[51] Int. Cl.[7] ..... B27C 9/00

[52] U.S. Cl. ..... 144/48.6; 144/135.2; 144/286.1; 144/286.5

[58] Field of Search ..... 144/1.1, 48.5, 144/48.6, 134.1, 135.2, 136.95, 154.5, 371, 286.1, 286.5; 83/574; 409/131, 228, 229, 184

[56] References Cited

U.S. PATENT DOCUMENTS 5,139,065 8/1992 Stark .
5,398,740 3/1995 Miller ..... 144/135.2
5,533,556 7/1996 Whitney .
5,725,038 3/1998 Tucker et al. .

FOREIGN PATENT DOCUMENTS 2001943 11/1989 Canada .

*Primary Examiner*—W. Donald Bray
*Attorney, Agent, or Firm*—McFadden, Fincham

[57] ABSTRACT

A jig for fastening to a hand-held power tool such as a router, effectively converting the tool to a bench mount type tool. The jig comprises a mount plate consisting of first and second separable halves that join to clamp the tool within an opening within the plate, and a member for fastening the jig to a workbench or the like. As well, removable legs elevate the jig above a work surface. The fastening member may consist of either a tongue extending from the mount plate, or the mount plate may alternatively fasten to a separable member for clamping to a workbench or the like.

12 Claims, 4 Drawing Sheets

POWER TOOL MOUNTING JIG

FIELD OF THE INVENTION

The invention relates to a mount or jig for releasably engaging a hand-held power tool, such as a router or jigsaw for woodworking or the like. The mount is adapted for securing the face plate of the tool to a workbench or other work surface for temporary conversion of the hand-held tool to a bench-mounted tool.

BACKGROUND OF THE INVENTION

It is desirable for many home shop applications such as for home woodworking to temporarily convert a hand-held power tool to a bench-mounted tool. For example, a hand-held router or jigsaw may be bench mounted to permit greater accuracy and speed of use. It may also be desirable to mount other types of tools to a bench, for the same purpose.

Within the prior art, several such mounting devices have been proposed. For example, U.S. Pat. No. 5,139,065 (Stark) discloses a holder for engaging a router to a workbench clamp or the like, comprising a plate having a central slot to receive the router. The base plate of the router is provided with a corresponding mounting member that mounts to the holder by way of special mounting rods. This device requires the router be supplied with a face plate having a pair of rods that mates with the holder, and is not suitable for use with tools that are not specifically adapted for the device.

U.S. Pat. No. 5,725,038 (Tucker et al) discloses a router plate incorporated within a table top, and having a circular opening to receive a router. The router is equipped with a corresponding disc-shaped plate for releasable mounting within the table top.

It is desirable to provide a mounting apparatus that may be readily adapted to receive a variety of hand held power tools, without any special modification to the tools. A further need is to provide a mount that easily attaches and detaches from a hand tool, but which still firmly engages the tool.

Conveniently, the mounting jig may be readily clamped to a conventional workbench. In one type of conventional work bench, commonly found in home hobby shops, the bench top comprises a pair of separable plates that combine the functions of a clamp and work surface. One such work bench is sold under the brand name "Black & Decker Work Mate" (TM). Conveniently, a power tool mounting jig includes a member that may be clamped between the separable parts of a Work Mate type tool bench or other clamping mechanism for fixedly mounting the power tool.

Conveniently, a tool mounting jig of the type represented by the present invention also converts directly into a workbench, to provide the user with a work surface having selectively a router bit, jigsaw blade or other power tool member extending through the surface, depending on the mounting configuration selected. A conventional hand-held router includes a generally circular faceplate for contacting the wood surface. Conveniently, a mount may be provided that clampingly engages this circular plate and incorporates this plate within a larger work surface, which also conveniently includes mounts for a guide fence and other workplace guides.

The mounting jig of the type represented by the present invention is specifically intended for use with a power tool that incorporates a face plate for contacting a board or other workpiece. Tools of this type are intended to glide along a board surface while performing an operation such as cutting or gouging. The present type of jig permits a tool to be held in place while a workpiece is moved against the tool. This will permit greater accuracy in certain applications.

SUMMARY OF THE INVENTION

It is an object of the present invention to provide a jig for mounting a variety of hand-held power tools, to effectively convert the tool to a bench-mount type tool. It is a further object to provide a jig specifically adapted to convert a hand-held router to a bench-mount type router. It is a further object to provide a jig that may be mounted to a workbench or alternatively be converted into a workbench by means of the attachment of legs or the like.

In accordance with these objects, the invention comprises in one aspect a jig for converting a hand held power tool having a faceplate for contacting a work piece, to a bench-mount type tool, the jig comprising:

- a mount plate comprised of first and second separable portions, meeting when in a closed position at a junction defined by mating edges;
- means joining the first and second portions;
- an opening extending through the mount plate, with the junction extending through the opening such that when the first and second plate portions are separated, the opening widens;
- a recessed portion within an upper surface of the mount plate at the opening to receive and clampingly engage the face plate of a hand-held tool, such as a router, within the opening when the first and second portions are in the closed position, in a position whereby the face plate of the tool is recessed within the recessed portion and is flush with the mount plate.

Preferably the lower surface of the mount plate is characterized by a corresponding lower recess for engaging a portion of the tool spaced from the base plate. One or more resilient members such as pads are preferably mounted within the lower recess for biasing the tool against the mount plate for fixedly retaining the tool to the jig with minimal vibration or movement when in use.

Preferably, a hinge means pivotally joins together the first and second portions, at an end of the respective portions.

Preferably, a generally rectangular tongue extends from the mount plate for engagement by a clamp, for example in a Work Mate-type workbench. The junction conveniently extends through the tongue to form two tongue halves, whereby clamping engagement of the tongue halves clamps the first and second portions of the mount plate tightly together.

The jig optionally includes a base such as legs for supporting and elevating the mount plate, with the base being conveniently removable.

Conveniently, slots are recessed into the lower surface of the mount plate for receiving legs for supporting the apparatus and optionally converting the apparatus into a free-standing jig/bench combination.

In another version, the mount plate is separable from a retainer portion of the apparatus, with the retainer portion being releasably engageable to a clamp. The clamp portion includes the generally rectangular tongue for engagement to a Work Mate-type table or other workbench clamp. The clamp mount may include a generally U-shaped retainer member for engaging and supporting opposing sides of the mount plate.

Conveniently, the mount plate may be adapted to engage a conventional router. In other versions, the plate is adapted to engage the faceplate of a jigsaw.

The directional references used herein refer to the device in the conventional working position with the work surface thereof horizontal and facing upwardly.

DETAILED DESCRIPTIONS OF THE PREFERRED EMBODIMENTS

Figure 1:
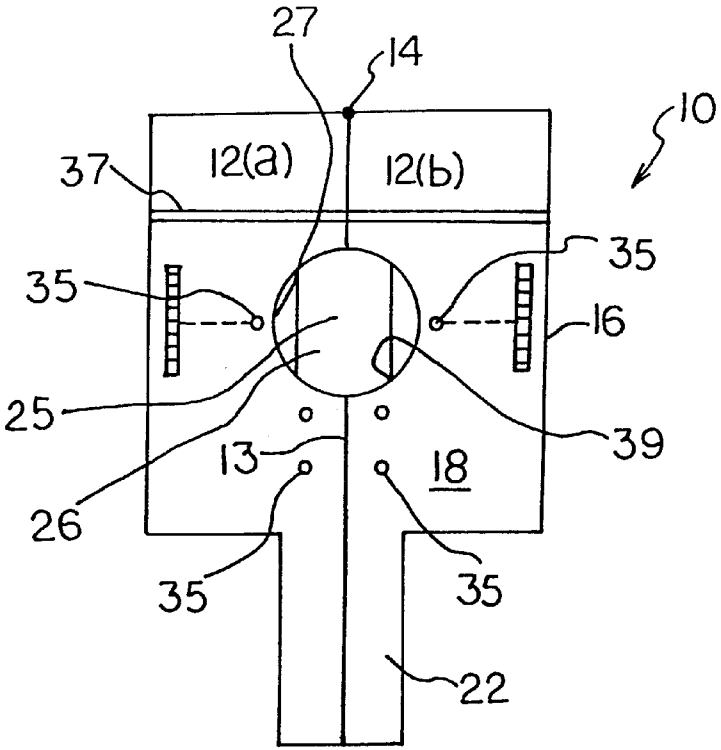
FIG. 1 is a plan view of the present apparatus, in the closed position.
Figure 2:
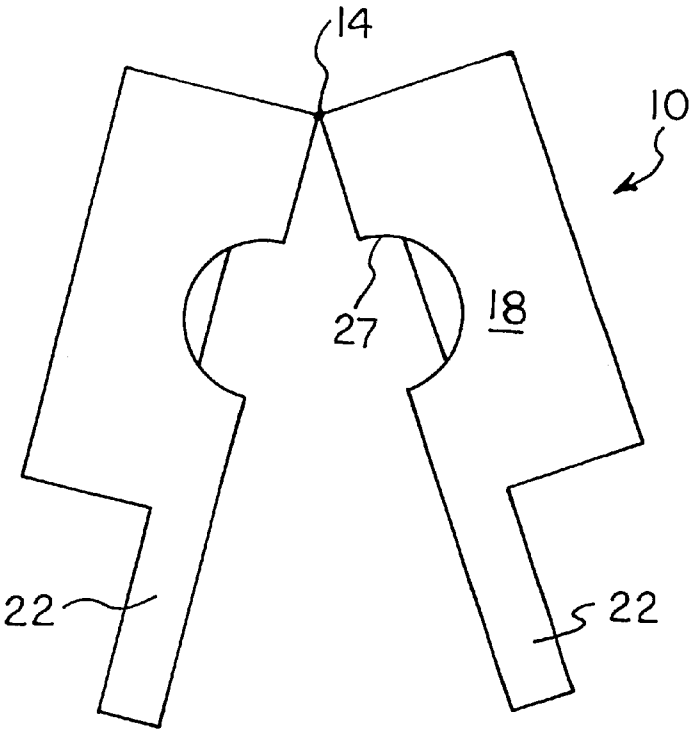
FIG. 2 is a plan view of the apparatus in the open position for receiving a power tool.
Figure 4:
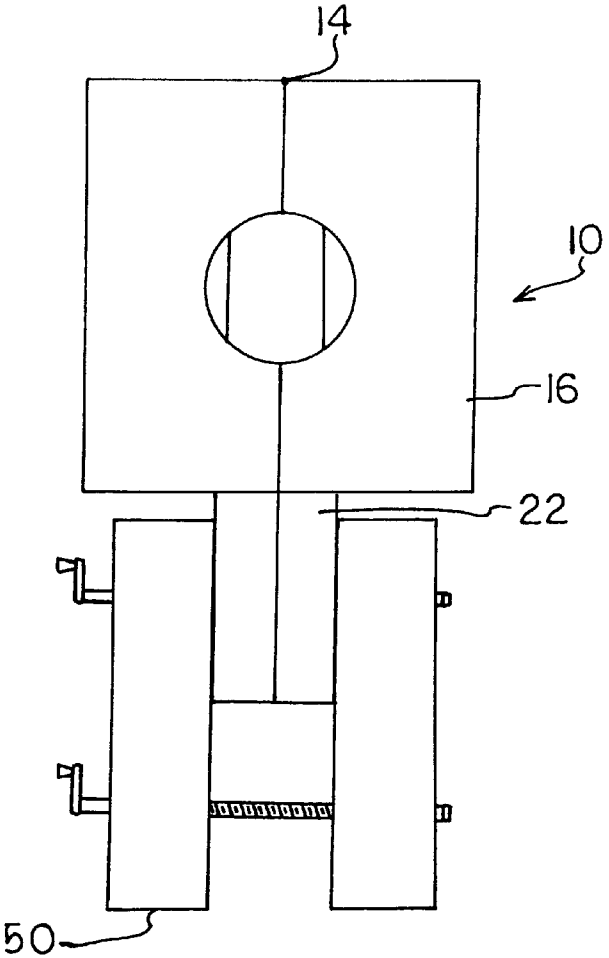
FIG. 4 is a plan view showing the apparatus engaged by a work bench.
Figure 3:
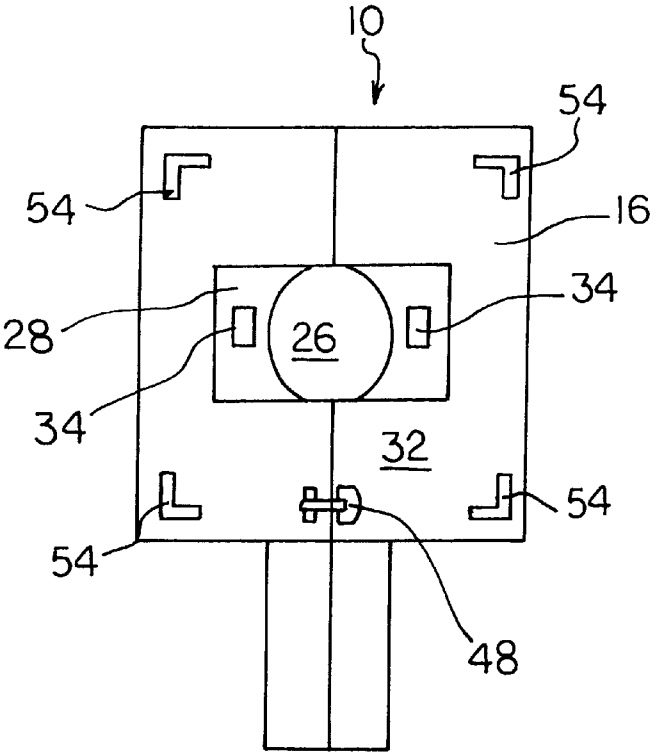
FIG. 3 is a plan view from below, of the apparatus.
Figure 5:
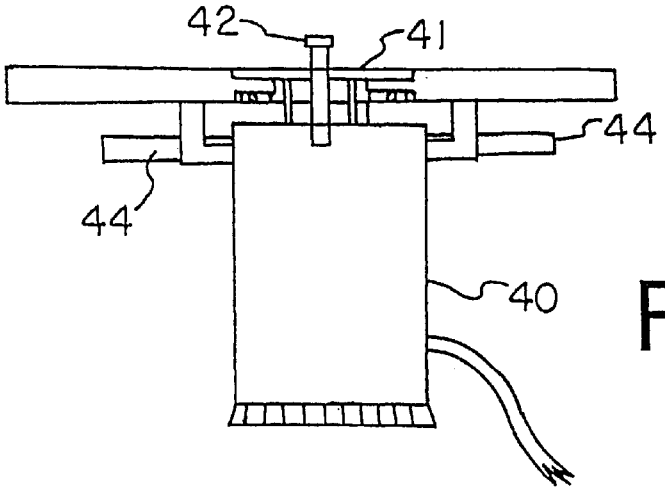
FIG. 5 is a partly sectional view, showing a power tool engaged by the apparatus.

A first embodiment of the invention is shown in FIGS. 1 to 7. The apparatus 10 comprises generally a bifurcated hinged jig for mounting a router or other hand-held power tool to a work bench. The apparatus is generally plate-like, and comprises first and second flat mating plates 12(*a*) and (*b*) hinged together by a hinge 14. The first and second plates abut at a midline joint 13 substantially bisecting the device. FIG. 1 illustrates the apparatus in the closed position and FIG. 2 illustrates the apparatus in the open position for receiving a router or the like. The first and second plates when mated form a monolithic generally rectangular mount plate 16 having a substantially flat and smooth upper work surface 18 and an elongate rectangular tongue or tail 22 for engagement between the jaws of a conventional work bench clamp. The mount plate is characterized by a central circular recess 25, having a generally vertical sidewall 27. The side wall is coated with a rubber layer for gripping the base plate of a tool, as described below. Alternatively, a rubber bushing 39 forms the inner layer. The floor of the recess communicates with an opening 26 extending through the apparatus. The recess and opening are substantially bisected by the midline joint 13. The bottom face 32 of the mount plate 16 (seen in FIG. 3) features a rectangular recess 28, communicating with the opening 26. The rectangular opening accommodates handles or the like extending from the power tool. Mounted within the recess 28 on either side of the opening 26 are a pair of resilient pads 34, the function of which is described below.

The mount plate 12 conveniently includes a variety of recesses 35 for receiving conventional workpiece guide members, such as guide pins and fences. As well, a conventional mitre slot 37 may extend across the plate.

In use, the apparatus opens along the midline joint 13. A router 40 or the like is placed within the opening such that the faceplate 41 of the router sits within the circular recess, and the apparatus is then closed. The router is positioned within the opening such that the router bit 42 faces upwardly. Closure of the mount ensures that the faceplate is firmly retained with the opening. The rubberized sidewall 27 of the jig clampingly engage the base plate and prevent rotation of the tool within the jig. The resilient pads 34 are positioned to contact the handles 44 of the router to bias the router downwardly, thus assisting in engaging the router to the jig in a secure, vibration free manner. The router is positioned vertically such that the respective work surfaces of the mount plate 16 and the tool faceplate are generally flush. The two halves of the apparatus are held together by means of a clasp 48 on the underside of the apparatus.

Figure 7:
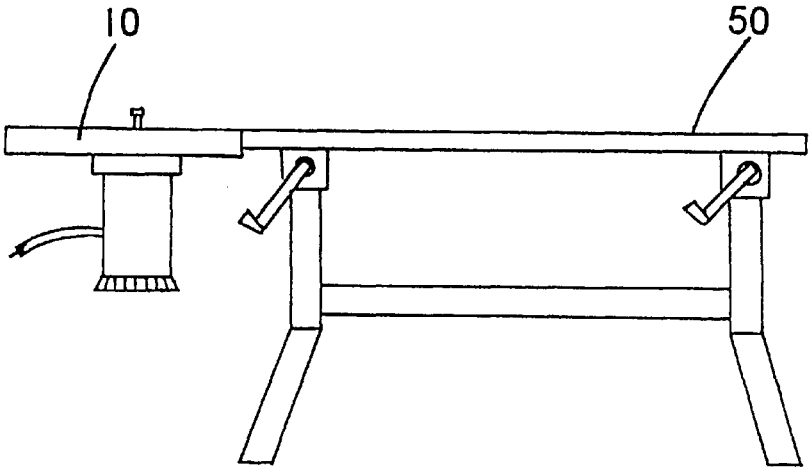
FIG. 7 is an elevational view of the apparatus mounted to a workbench.

With the tool thus engaged within the jig, the tail 22 of the jig may then be clampingly engaged within a conventional workbench 50, with the router pointing upwardly. Conveniently, the workbench may comprise a Black & Decker (TM) Work Mate (TM) workbench or the like comprising separable halves which clamp together. The clamping together of the tail 22 clamps the router within the apparatus, and holds the apparatus in position for use. As seen in FIG. 7, the work surface of the jig 10 is conveniently mounted to be generally flush with the work surface of the workbench 50, with the router clampingly held within the jig, facing upwardly, permitting the user to move the workpiece against the tool for improved control relative to the reverse arrangement.

Figure 6:
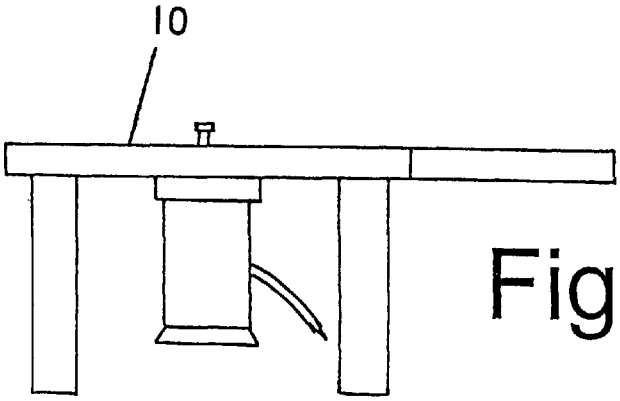
FIG. 6 is an elevational view of the apparatus with support legs mounted thereto.

The underside of the mount plate may be provided with angled slots 54 at each corner, for receiving corresponding legs to elevate the jig above a surface, to convert the apparatus into a free-standing tool, as seen in FIG. 6.

Figure 8:
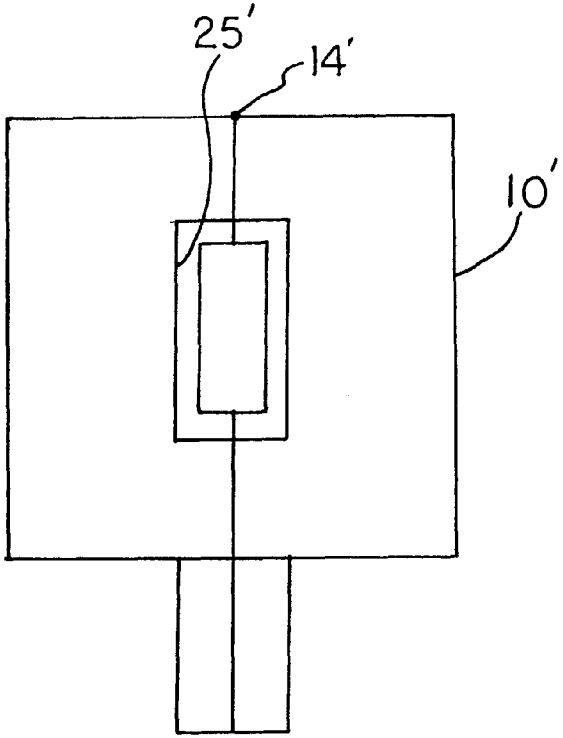
FIG. 8 is a plan view of a second embodiment of the apparatus.

In an alternative version seen in FIG. 8, the central recess 25' is rectangular for mounting a tool having a rectangular faceplate such as a jig saw.

Figure 9:
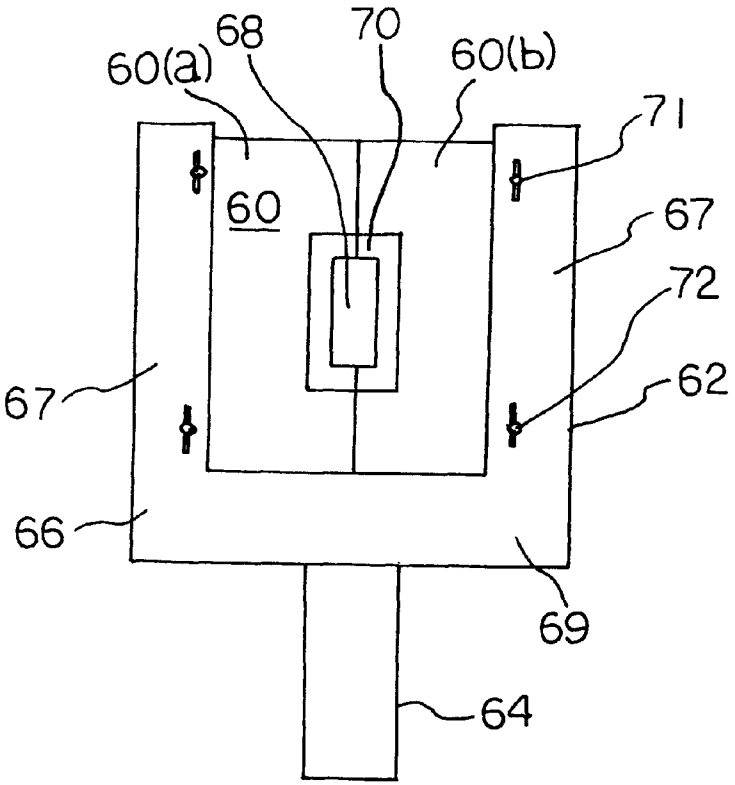
FIG. 9 is a plan view of a third embodiment of the apparatus.

An alternative version is shown in FIG. 9. In this version, a universal retainer portion 62 of the jig retains a variety of mount plates 60. This conveniently permits the provision of a jig for engaging a variety of tools, since the user is required to have on hand only a selection of mount plates rather than complete jigs. The retainer portion 62 of this version comprises a generally Y-shaped member, having a rectangular tongue 64 for engagement with a clamp, and a U-shaped portion 66 for engagement with the mount plate 60. The U-shaped portion comprises two spaced apart parallel limbs 67, joined at one end by a third limb 69. The mount plate 60 comprises a generally rectangular platelike member comprised of two parts 60(*a*) and 60(*b*) hinged together at one end and joining along a generally central mid-line joint. A central opening 68 and a surrounding recess 70 engage the faceplate of a hand tool such as a jigsaw. The mount plate 60 fits when assembled into the retainer portion by means of a mating tongue and groove arrangement within the abutting edge surfaces. When thus inserted into the retainer, the two parts 60(*a*) and (*b*) of the mount plate clampingly engage a power tool in the same manner as described above.

It will be seen that with suitable modifications, the jig may be adapted to retain a tool having a face plate of virtually any configuration.

Although the present invention has been described and illustrated by way of preferred embodiments thereof, it will be seen by those skilled in the art to which the invention pertains that numerous departures from and variations to the present apparatus may be made without departing from the spirit and scope of the present invention, as defined in the claims.

I claim:

1. A jig for releasably mounting a hand held power tool having a face plate, comprising:

a planar mount plate having upper and lower surfaces and opposed sides, said mount plate comprised of first and second separable portions each having ends and sides and meeting when in a closed position at a junction defined by corresponding mating sides of said portions;

means for joining said first and second portions together to form a monolithic platelike member;

an opening extending through said mount plate;

at least one recess within said upper surface of said mount plate communicating with said opening, said junction extending through said recess and said opening whereby when said portions are separated relative to each other said recess and opening widen to receive said face plate of the tool and when said first and second portions are in said closed position said face plate may be clampingly engaged within said recess.

2. A jig as in claim 1, wherein the lower surface of said mount plate is characterized by a recess communicating with said opening.

3. A jig as in claim 1, further including a hinge means for pivotally joining together said first and second portions together at an end of said portions.

4. A jig as in claim 1, further including a generally rectangular tongue, extending from said mount plate for engagement by a workbench clamp.

5. A jig as in claim 4, wherein said junction extends through said tongue whereby clamping engagement of opposing sides of said tongue clamps said first and second portions together to engage said tool face plate within said recess.

6. A jig as in claim 1, further comprising a removable support for supporting and elevating said mount plate above a surface.

7. A jig as in claim 6, wherein said support comprises legs removably mounted to said mount plate.

8. A jig as in claim 1, wherein said mount plate is removably retained within a retainer having a recess therein adapted to releasably receive said mount plate.

9. A jig as in claim 8, wherein said retainer comprises a generally U-shaped member composed of parallel opposed side limbs and a third connecting limb, said mount plate being releasably received between said side and connecting limbs.

10. A jig as in claim 8, wherein said retainer is further provided with a generally rectangular tongue for engagement by a workbench clamp, said tongue extending from said third connecting limb.

11. A jig as in claim 8, wherein said mount plate and said retainer include mating tongue and groove projections for releasable engagement there between.

12. A jig as in claim 1, wherein there is further provided resilient biasing means on the lower surface of said plate positioned to contact said tool to bias said tool downwardly.

* * * * *